US009995515B2

(12) United States Patent
Liu

(10) Patent No.: US 9,995,515 B2
(45) Date of Patent: Jun. 12, 2018

(54) FROZEN EVAPORATOR COIL DETECTION AND DEFROST INITIATION

(71) Applicant: Carrier Corporation, Farmington, CT (US)

(72) Inventor: Lucy Yi Liu, Fayetteville, NY (US)

(73) Assignee: CARRIER CORPORATION, Farmington, CT (US)

( * ) Notice: Subject to any disclaimer, the term of this patent is extended or adjusted under 35 U.S.C. 154(b) by 539 days.

(21) Appl. No.: 14/418,259

(22) PCT Filed: Jul. 29, 2013

(86) PCT No.: PCT/US2013/052483

§ 371 (c)(1),
(2) Date: Jan. 29, 2015

(87) PCT Pub. No.: WO2014/022269

PCT Pub. Date: Feb. 6, 2014

(65) Prior Publication Data

US 2015/0204589 A1 Jul. 23, 2015

Related U.S. Application Data

(60) Provisional application No. 61/677,730, filed on Jul. 31, 2012.

(51) Int. Cl.
*F25D 21/06* (2006.01)
*F25B 47/02* (2006.01)
(Continued)

(52) U.S. Cl.
CPC ..... *F25B 47/02* (2013.01); *F25B 1/10* (2013.01); *F25B 41/04* (2013.01);
(Continued)

(58) Field of Classification Search
CPC .. F25B 47/02; F25B 1/10; F25B 41/04; F25B 2700/21171; F25B 2400/13;
(Continued)

(56) References Cited

U.S. PATENT DOCUMENTS 5,272,395 A 12/1993 Vincelette
5,337,574 A 8/1994 Dick
(Continued)

FOREIGN PATENT DOCUMENTS

CN 1095812 A 11/1994
CN 1955592 A 5/2007
(Continued)

OTHER PUBLICATIONS

Fukada et al., Frost Adhesion Detection Device, Jun. 16, 2000, JP2000161821A, Whole Document.*
(Continued)

*Primary Examiner* — Larry Furdge
(74) *Attorney, Agent, or Firm* — Cantor Colburn LLP

(57) ABSTRACT

A method is disclosed or detecting a frozen evaporator coil of a refrigerant vapor compression system for supplying conditioned air to a temperature controlled space before ice build-up on the evaporator coil becomes so excessive as to result in an undesirable on-off cycling of the refrigerant vapor compression system compressor when operating to a frozen temperature maintenance mode. The method may also include initiating a defrost of a frozen evaporator coil of the refrigerant vapor compression system before ice build-up on the evaporator coil becomes so excessive as to result in an on-off cycling of the refrigerant vapor compression system compressor when operating to a frozen temperature maintenance mode.

9 Claims, 3 Drawing Sheets

(51) Int. Cl.
*F25B 1/10* (2006.01)
*F25B 41/04* (2006.01)

(52) U.S. Cl.
CPC ..... *F25B 2347/023* (2013.01); *F25B 2400/13* (2013.01); *F25B 2700/1933* (2013.01); *F25B 2700/21161* (2013.01); *F25B 2700/21171* (2013.01)

(58) Field of Classification Search
CPC .... F25B 2700/1933; F25B 2700/21161; F25B 2347/023
See application file for complete search history.

(56) References Cited

U.S. PATENT DOCUMENTS

| | | | | |
|---|---|---|---|---|
| 5,699,670 | A | 12/1997 | Jurewicz et al. | |
| 5,704,217 | A * | 1/1998 | Itoh | B60H 1/3207 236/49.3 |
| 5,921,090 | A | 7/1999 | Jurewicz et al. | |
| 6,112,534 | A | 9/2000 | Taras et al. | |
| 6,220,047 | B1 | 4/2001 | Vogel et al. | |
| 6,584,802 | B1 | 7/2003 | Cofield et al. | |
| 6,708,510 | B2 | 3/2004 | Sulc et al. | |
| 6,895,764 | B2 | 5/2005 | Viegas et al. | |
| 6,964,172 | B2 | 11/2005 | Dudley et al. | |
| 7,418,823 | B2 | 9/2008 | Sato et al. | |
| 8,136,363 | B2 | 3/2012 | Ludwig | |
| 2003/0140644 | A1 | 7/2003 | Wightman | |
| 2005/0172648 | A1 | 8/2005 | Concha et al. | |
| 2006/0248904 | A1* | 11/2006 | Ludwig | B60H 1/00014 62/151 |
| 2010/0251742 | A1 | 10/2010 | Tucker et al. | |
| 2011/0042054 | A1 | 2/2011 | Ladkat | |
| 2011/0088883 | A1 | 4/2011 | de la Cruz et al. | |

FOREIGN PATENT DOCUMENTS

| | | | | |
|---|---|---|---|---|
| CN | 101256045 | A | | 9/2008 |
| CN | 201281520 | Y | | 7/2009 |
| EP | 0147825 | A2 | | 7/1985 |
| EP | 0164948 | A2 | | 12/1985 |
| JP | H01266458 | A | | 10/1989 |
| JP | H11211186 | A | | 8/1999 |
| JP | 2000161821 | A | * | 6/2000 |
| JP | 2001221564 | A | * | 8/2001 |
| JP | 2007225158 | A | | 9/2007 |
| KR | 20040012046 | A | * | 2/2004 |
| WO | 2011051000 | A1 | | 5/2011 |
| WO | 2011112411 | A1 | | 9/2011 |
| WO | 2012003202 | A2 | | 1/2012 |

OTHER PUBLICATIONS

Choi, The defrost Operation Control Method of Cooling and Heating Air Conditioner, Feb. 11, 2004, KR20040012046, Whole Document.*

Hori et al., Showcase Managing Device and Showcase System, Aug. 17, 2001, JP2001221564A, Whole Document.*

Singapore Office Action for application 11201500570W, dated Nov. 19, 2015, 2 pages.

International Search Report for application No. PCT/US2013/052483, dated Mar. 31, 2014, 4 pages.

Written Opinion for application No. PCT/US2013/052483, dated Mar. 31, 2014, 6 pages.

Chineses Office Action and Search for application CN 201380042438.X, dated Feb. 3, 2016, 7 pages.

* cited by examiner

FROZEN EVAPORATOR COIL DETECTION AND DEFROST INITIATION

BACKGROUND OF THE DISCLOSURE

This disclosure relates generally to refrigerant vapor compression systems and, more particularly, to detecting and defrosting the heat exchanger coil of an evaporator of a refrigerant vapor compression system when supplying cold air to a temperature controlled space being maintained at a temperature below the freezing point of water (32° F./0° C.).

Refrigerant vapor compression systems used in connection with transport refrigeration systems are generally subject to stringent operating conditions due to the wide range of operating load conditions and the wide range of outdoor ambient conditions over which the refrigerant vapor compression system must operate to maintain product within the cargo space at a desired temperature. The desired temperature at which the cargo needs to be controlled can also vary over a wide range depending on the nature of cargo to be preserved. For example, for fresh products, such as produce, dairy products, fresh meats, fresh poultry, the control set point air temperature returning from the controlled temperature space to the evaporator may typically range from 34° F. up to 86° F. (1° C. to 30° C.), while for frozen products, such as ice cream, seafood, frozen meat and poultry, and other frozen items, the control set point air temperature typically may range from 32° F. down to −30° F. (0° C. to −34.4° C.).

When the refrigerant vapor compression system is operating in a frozen temperature control mode for maintaining air temperature within a temperature controlled space below 32° F. (0° C.), the temperature of the refrigerant will be so low that the heat transfer surfaces of the evaporator coil will be less than 32° F. (0° C.). Thus moisture in the air returning to the evaporator from the temperature controlled space will deposit as ice on the heat transfer surfaces of the evaporator coil. As ice builds up on the evaporator coil, the air flow rate is reduced because the build-up of ice blocks off portions of the air flow passages over the evaporator coil.

Additionally, the build-up of ice on the exposed heat transfer surfaces of the evaporator coil creates additional thermal resistance to the transfer of heat from the air flow to the refrigerant passing through the heat exchange tubes of the evaporator coil, thereby degrading the heat transfer performance of the evaporator coil and lowering the cooling capacity of the evaporator coil. As the evaporator coil cooling capacity decreases, the lesser amount of refrigerant that can be evaporated in passing through the evaporator coil. In response to the reduced cooling capacity, the evaporator expansion valve reduces its flow opening to reduce the mass flow of refrigerant passing through the evaporator coil. As a consequence, the refrigerant pressure within the evaporator coil and downstream thereof, including the refrigerant at the suction inlet to the compressor, referred to as the suction pressure, is lowered. If the suction pressure drops below a preset lower limit, the system will cycle off to avoid possible damage to the compressor. However, as a cooling demand is still imposed on the system, the system will cycle back on. An undesirable on-off cycling of the compressor may ensue.

SUMMARY OF THE DISCLOSURE

In an aspect, a method disclosed herein provides for the detection of a frozen evaporator coil of a refrigerant vapor compression system for supplying conditioned air to a temperature controlled space before ice build-up on the evaporator coil becomes so excessive as to result in an undesirable on-off cycling of the refrigerant vapor compression system compressor when operating to maintain a box temperature below freezing.

In an aspect, the method disclosed herein provides for initiating a defrost of a frozen evaporator coil of a refrigerant vapor compression system for supplying conditioned air to a temperature controlled space before ice build-up on the evaporator coil becomes so excessive as to result in an undesirable on-off cycling of the refrigerant vapor compression system compressor when operating to maintain a box temperature below freezing.

In an embodiment, the method includes determining whether a change in an air flow temperature differential across the evaporator heat exchanger coil over a first preselected period of time at least equals a set point threshold change in air flow temperature differential; and determining whether a change in a refrigerant pressure condition on a low pressure side of the refrigerant vapor compression system over a second preselected period of time at least equals a set point threshold change in refrigerant pressure condition. If both the change in an air flow temperature differential across the evaporator heat exchanger coil over the first preselected period of time at least equals a set point threshold change in air flow temperature differential and the change in a refrigerant pressure condition on a low pressure side of the refrigerant vapor compression system over the second preselected period of time at least equals a set point threshold change in refrigerant pressure condition, a warning indicating that the evaporator heat exchanger coil is becoming excessively frosted is generated.

In an embodiment, the method includes determining whether a current magnitude of the air flow temperature differential across the evaporator heat exchanger coil at least equals a set point threshold magnitude for the air flow temperature differential, and determining whether a current magnitude of the evaporator heat exchanger coil refrigerant pressure condition at least equals a set point threshold magnitude for the refrigerant pressure condition. If both the current magnitude of the air flow temperature differential across the evaporator heat exchanger coil at least equals a set point threshold magnitude for the air flow temperature differential, and the current magnitude of the evaporator heat exchanger coil refrigerant pressure condition at least equals a set point threshold magnitude for the refrigerant pressure condition, the method further includes initiating a defrost of the evaporator heat exchanger coil.

Determining whether a change in an air flow temperature differential across the evaporator heat exchanger coil over the first preselected period of time at least equals a set point threshold change in air flow temperature differential may include: at a first time sensing the return air temperature of the air flow returning from the temperature controlled space to pass over the evaporator heat exchanger coil, sensing the supply air temperature of the air flow having passed over the evaporator heat exchanger coil to be supplied to the temperature controlled space, and calculating the air flow temperature differential at the first time by subtracting the sensed supply air temperature from the return air temperature; at a second time after the first time by the first preselected period of time sensing the return air temperature of the air flow returning from the temperature controlled space to pass over the evaporator heat exchanger coil, sensing the supply air temperature of the air flow having passed over the evaporator heat exchanger coil to be supplied to the temperature controlled space, and calculating the air flow temperature differential at the second time by subtracting the sensed supply air temperature from the return air temperature; thence calculating a differential between the air flow temperature differential at the second time and the air flow temperature differential at the first time; and comparing the differential between the air flow temperature differential at the second time and the air flow temperature differential at the first time to the set point threshold change in air flow temperature differential. In an embodiment, the first and second preselected periods of time are equal in duration and coincident.

Determining whether a change an evaporator heat exchanger coil refrigerant pressure condition over the second preselected period of time at least equals a set point threshold change in refrigerant pressure condition may include: sensing the evaporator heat exchanger coil refrigerant pressure condition at a first time and a second time the preselected period of time after the first time; calculating a change in the evaporator heat exchanger coil refrigerant pressure condition over the selected period of time by subtracting the magnitude of the sensed evaporator heat exchanger coil refrigerant pressure condition at the first time from the magnitude of the sensed evaporator heat exchanger coil refrigerant pressure condition at the second time; and comparing the calculated change in the evaporator heat exchange coil refrigerant pressure condition to the set point threshold change in refrigerant pressure condition. The refrigerant pressure condition on a low pressure of the refrigerant vapor compression system may be selected from the group consisting of a compressor suction pressure, an evaporator outlet refrigerant pressure, and an evaporator inlet refrigerant pressure. In an embodiment, the first and second preselected periods of time are equal in duration and coincident.

In an embodiment of the method wherein the refrigerant vapor compression system is a transcritical refrigerant vapor compression system charged with carbon dioxide refrigerant, the set point threshold magnitude of the sensed evaporator heat exchanger coil refrigerant pressure condition is greater than 5.2 bars absolute, the triple point of carbon dioxide. In an embodiment, the set point threshold magnitude of the air flow temperature differential is greater than 20° F. (11° C.).

BRIEF DESCRIPTION OF THE DRAWINGS

For a further understanding of the disclosure, reference will be made to the following detailed description which is to be read in connection with the accompanying drawing, wherein.

DETAILED DESCRIPTION OF THE INVENTION

Figure 1:
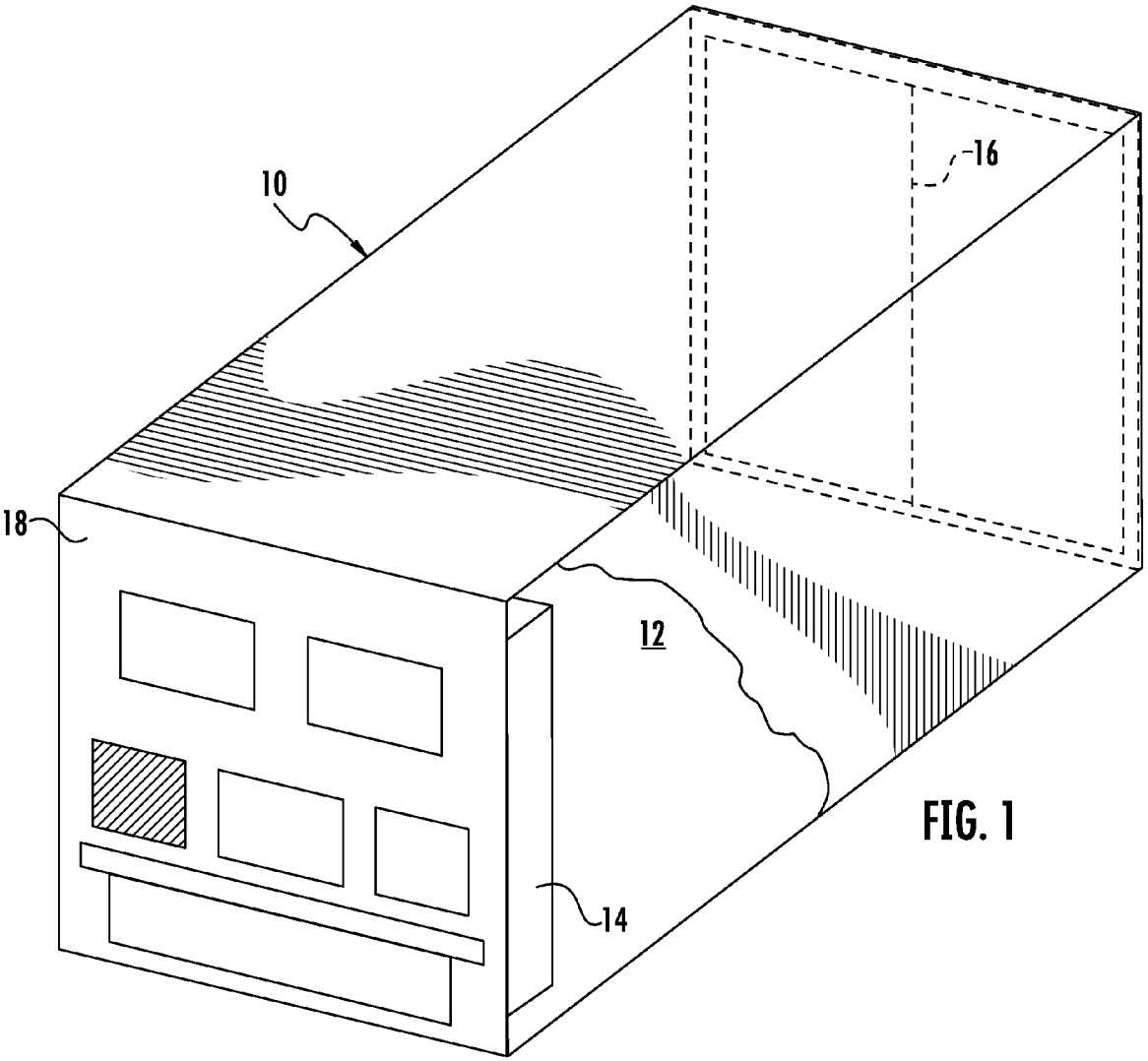
FIG. 1 is perspective view of a refrigerated container equipped with a transport refrigeration unit.

There is depicted in FIG. 1 an exemplary embodiment of a refrigerated container 10 having a temperature controlled cargo space 12 the atmosphere of which is refrigerated by operation of a transport refrigeration unit 14 associated with the cargo space 12. In the depicted embodiment of the refrigerated container 10, the transport refrigeration unit 14 is mounted in an opening in the front wall of the refrigerated container 10 as in conventional practice. However, the refrigeration unit 14 may be mounted in or on the roof, floor or any wall of the refrigerated container 10. Additionally, the refrigerated container 10 has at least one access door 16 through which perishable products and goods, fresh or frozen, may be loaded into and removed from the cargo space 12 of the refrigerated container 10.

Figure 2:
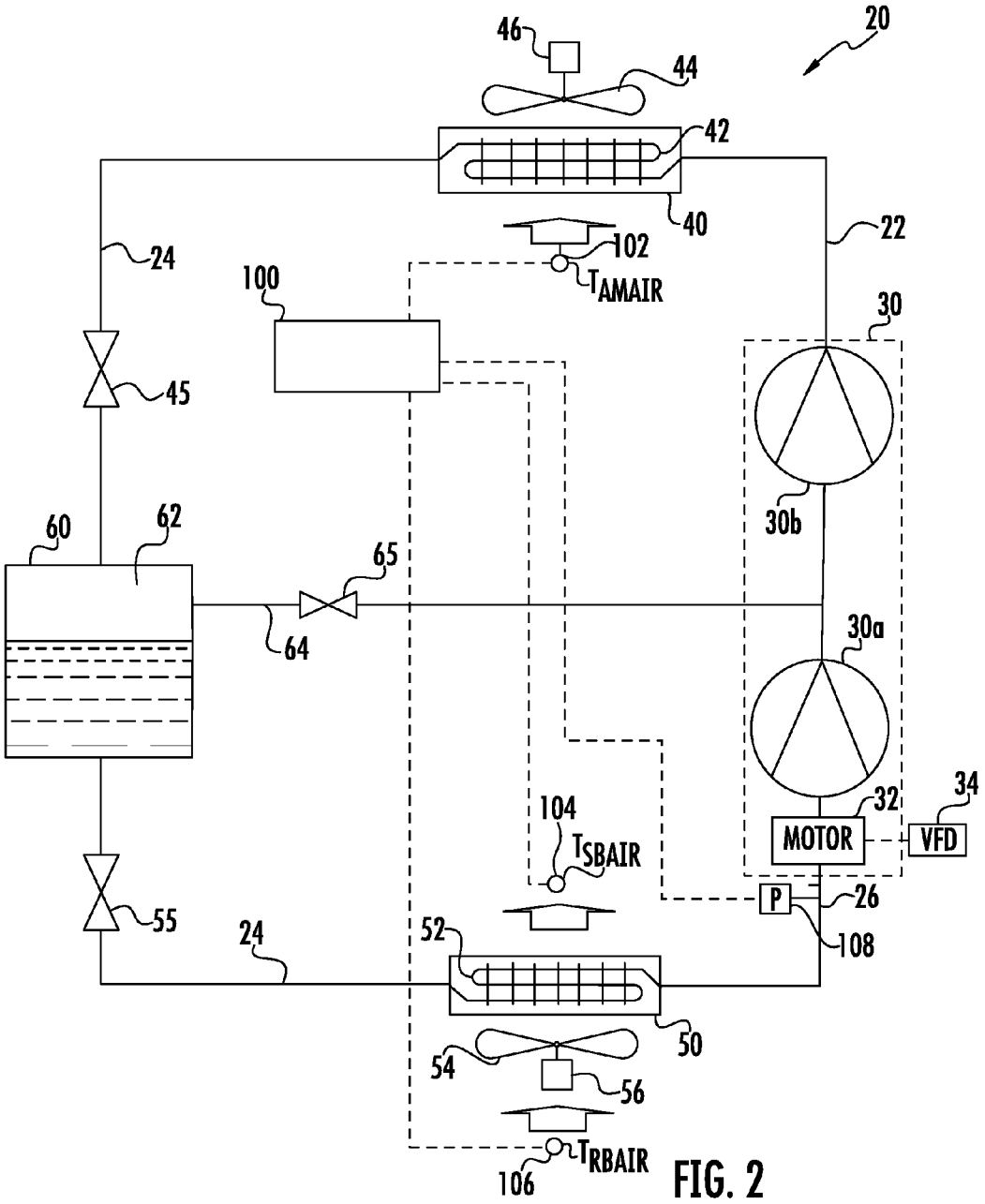
FIG. 2 is a schematic illustration of an embodiment of the refrigerant vapor compression system of the transport refrigeration unit that may be operated in accord with the method disclosed herein.

The transport refrigeration unit 14 includes a refrigerant vapor compression system 20 for refrigerating air drawn from and supplied back to the temperature controlled space 12. Referring now to FIG. 2, there is depicted schematically an embodiment of a refrigerant vapor compression system 20 suitable for use in the transport refrigeration unit 14 for refrigerating air drawn from and supplied back to the temperature controlled cargo space 12. Although the refrigerant vapor compression system 20 will be described herein in connection with a refrigerated container 10 of the type commonly used for transporting perishable goods by ship, by rail, by land or intermodally, it is to be understood that the refrigerant vapor compression system 20 may also be used in transport refrigeration units for refrigerating the cargo space of a truck, a trailer or the like for transporting perishable products and goods, fresh or frozen. The refrigerant vapor compression system 20 is also suitable for use in conditioning air to be supplied to a climate controlled comfort zone within a residence, office building, hospital, school, restaurant or other facility. The refrigerant vapor compression system 20 could also be employed in refrigerating air supplied to display cases, merchandisers, freezer cabinets, cold rooms or other perishable and frozen product storage areas in commercial establishments.

The refrigerant vapor compression system 20 includes a multi-stage compression device 30, a refrigerant heat rejection heat exchanger 40, a flash tank 60, and a refrigerant heat absorption heat exchanger 50, also referred to herein as an evaporator, with refrigerant lines 22, 24 and 26 connecting the aforementioned components in serial refrigerant flow order in a primary refrigerant circuit. A high pressure expansion device (HPXV) 45, such as for example an electronic expansion valve, is disposed in the refrigerant line 24 upstream of the flash tank 60 and downstream of refrigerant heat rejection heat exchanger 40. An evaporator expansion device (EVXV) 55, such as for example an electronic expansion valve, operatively associated with the evaporator 50, is disposed in the refrigerant line 24 downstream of the flash tank 60 and upstream of the evaporator 50.

The compression device 30 compresses the refrigerant and to circulate refrigerant through the primary refrigerant circuit as will be discussed in further detail hereinafter. The compression device 30 may comprise a single, multiple-stage refrigerant compressor, for example a reciprocating compressor or a scroll compressor, having a first compression stage 30*a* and a second stage 30*b*, wherein the refrigerant discharging from the first compression stage 30*a* passes to the second compression stage 30*b* for further compression. Alternatively, the compression device 30 may comprise a pair of individual compressors, one of which constitutes the first compression stage 30*a* and other of which constitutes the second compression stage 30*b*, connected in series refrigerant flow relationship in the primary refrigerant circuit via a refrigerant line connecting the discharge outlet port of the compressor constituting the first compression stage 30*a* in refrigerant flow communication with the suction inlet port of the compressor constituting the second compression stage 30*b* for further compression. In a two compressor embodiment, the compressors may be scroll compressors, screw compressors, reciprocating compressors, rotary compressors or any other type of compressor or a combination of any such compressors. In both embodiments, in the first compression stage 30*a*, the refrigerant vapor is compressed from a lower pressure to an intermediate pressure and in the second compression stage 30*b*, the refrigerant vapor is compressed from an intermediate pressure to higher pressure.

In the embodiment of the refrigerant vapor compression system 20 depicted in FIG. 2, the compression device 30 is driven by a variable speed motor 32 powered by electric current delivered through a variable frequency drive 34. The electric current may be supplied to the variable speed drive 34 from an external power source (not shown), such as for example a ship board power plant, or from a fuel-powered engine drawn generator unit, such as a diesel engine driven generator set, attached to the front of the container. The speed of the variable speed compressor 30 may be varied by varying the frequency of the current output by the variable frequency drive 34 to the compressor drive motor 32. It is to be understood, however, that the compression device 30 may in other embodiments comprise a fixed speed compressor.

The refrigerant heat rejection heat exchanger 40 may comprise a finned tube heat exchanger 42 through which hot, high pressure refrigerant discharged from the second compression stage 30*b* (i.e. the final compression charge) passes in heat exchange relationship with a secondary fluid, most commonly ambient air drawn through the heat exchanger 42 by the fan(s) 44. The finned tube heat exchanger 42 may comprise, for example, a fin and round tube heat exchange coil or a fin and flat mini-channel tube heat exchanger. An electric motor 46 drives the fan(s) 44. The electric motor may be a single speed motor, a multiple speed motor operable at two or more fixed speeds, or a variable speed motor powered by a variable frequency drive, such as the variable speed drive 34 associated with the compression device motor 32 or a separate variable speed drive.

Depending upon whether the refrigerant vapor compression system is operating in a transcritical cycle or a subcritical cycle, the refrigerant heat rejection heat exchanger operates as a refrigerant gas cooler or a refrigerant condenser. Refrigerant vapor compression systems with conventional fluorocarbon refrigerants such as, but not limited to, hydrochlorofluorocarbons (HCFCs), such as R22, and more commonly hydrofluorocarbons (HFCs), such as R134a, R410A, R404A and R407C, operate in a subcritical cycle and the refrigerant heat rejection heat exchanger 40 functions as a refrigerant condenser. Refrigerant vapor compression systems charged with carbon dioxide as the refrigerant, instead of HFC refrigerants, are designed for operation in the transcritical pressure regime because of the low critical point of carbon dioxide. The method disclosed herein may be used in connection with refrigerant vapor compression systems operating in either a subcritical cycle or a transcritical cycle.

When the refrigerant vapor compression system 20 operates in a transcritical cycle, the pressure of the refrigerant discharging from the second compression stage 30*b* and passing through the refrigerant heat rejection heat exchanger 40, referred to herein as the high side pressure, exceeds the critical point of the refrigerant, and the refrigerant heat rejection heat exchanger 40 functions as a gas cooler. However, it should be understood that if the refrigerant vapor compression system 20 operates solely in the subcritical cycle, the pressure of the refrigerant discharging from the compressor and passing through the refrigerant heat rejection heat exchanger 40 is below the critical point of the refrigerant, and the refrigerant heat rejection heat exchanger 40 functions as a condenser.

The refrigerant heat absorption heat exchanger 50 may also comprise a finned tube coil heat exchanger 52, such as a fin and round tube heat exchanger or a fin and flat, mini-channel tube heat exchanger. Whether the refrigerant vapor compression system is operating in a transcritical cycle or a subcritical cycle, the refrigerant heat absorption heat exchanger 50 functions as a refrigerant evaporator. Before entering the evaporator 50, the refrigerant passing through the refrigerant line 24 traverses the evaporator expansion device 55, such as, for example, an electronic expansion valve or a thermostatic expansion valve, and expands to a lower pressure and a lower temperature to enter the heat exchanger 52.

As the two-phase (liquid and vapor) refrigerant traverses the heat exchanger 52, the two-phase refrigerant passes in heat exchange relationship with a heating fluid whereby the two-phase refrigerant is evaporated and typically superheated to a desired degree. The low pressure vapor refrigerant leaving the heat exchanger 52 passes through refrigerant line 26 to the suction inlet of the first compression stage 30*a*. The heating fluid may be air drawn by an associated fan(s) 54 from a climate controlled environment, such as a perishable/frozen cargo storage zone associated with a transport refrigeration unit, or a food display or storage area of a commercial establishment, or a building comfort zone associated with an air conditioning system, to be cooled, and generally also dehumidified, and thence returned to the climate controlled environment from which it was withdrawn. An electric motor 56 drives the fan(s) 54. The electric motor may be a single speed motor, a multiple speed motor operable at two or more fixed speeds, or a variable speed motor powered by a variable frequency drive, such as the variable speed drive 34 associated with the compression device motor 32 or a separate variable speed drive.

The flash tank 60, which is disposed in the refrigerant line 24 between the gas cooler 40 and the evaporator 50, upstream of the evaporator expansion valve 55 and downstream of the high pressure expansion device 45, functions as an economizer and a receiver. The flash tank 60 defines a chamber 62 into which expanded refrigerant having traversed the high pressure expansion device 45 enters and separates into a liquid refrigerant portion and a vapor refrigerant portion. The liquid refrigerant collects in the chamber 62 and is metered therefrom through the downstream leg of the refrigerant line 24 by the evaporator expansion device 55 to flow through the evaporator 50.

The vapor refrigerant collects in the chamber 62 above the liquid refrigerant and may pass therefrom through economizer vapor line 64 for injection of refrigerant vapor into an intermediate stage of the compression process. An economizer flow control device 65, such as, for example, a solenoid valve (ESV) having an open position and a closed position, is interposed in the economizer vapor line 64. When the refrigerant vapor compression system 20 is operating in an economized mode, the economizer flow control device 65 is opened thereby allowing refrigerant vapor to pass through the economizer vapor line 64 from the flash tank 60 into an intermediate stage of the compression process. When the refrigerant vapor compression system 20 is operating in a standard, non-economized mode, the economizer flow control device 65 is closed thereby preventing refrigerant vapor to pass through the economizer vapor line 64 from the flash tank 60 into an intermediate stage of the compression process.

In an embodiment where the compression device 30 has two compressors connected in serial flow relationship by a refrigerant line, one being a first compression stage 30*a* and the other being a second compression stage 30*b*, the vapor injection line 64 communicates with refrigerant line interconnecting the outlet of the first compression stage 30*a* to the inlet of the second compression stage 30*b*. In an embodiment where the compression device 30 comprises a single compressor having a first compression stage 30*a* feeding a second compression stage 30*b*, the refrigerant vapor injection line 64 can open directly into an intermediate stage of the compression process through a dedicated port opening into the compression chamber.

The refrigerant vapor compression system 20 also includes a controller 100 operatively associated with the plurality of flow control devices 45, 55 and 65 interdisposed in various refrigerant lines as previously described. As in conventional practice, in addition to monitoring ambient air temperature, $T_{AMAIR}$, by a temperature sensor 102, supply box air temperature, $T_{SBAIR}$, by means of a temperature sensor 104, and return box air temperature, $T_{RBAIR}$, by means of a temperature sensor 106, the controller 100 may also monitor various pressures and temperatures and operating parameters by means of various sensors operatively associated with the controller 100 and disposed at selected locations throughout the refrigerant vapor compression system 20. In connection with the method disclosed herein, the controller 100 monitors a pressure sensor 108 disposed in association with the suction inlet of the first compression stage 30*a* to sense the pressure of the refrigerant feeding to the first compression stage 30*a*, $P_{SUCT}$.

The temperature sensor 102 may be disposed in the ambient air flow being drawn into the gas cooler 40 by the fan(s) 44 at a location upstream of the heat exchanger coil 42. The temperature sensor 104 may be disposed in the flow of supply air having traversed the heat exchanger coil 52 of the evaporator 50 and passing back to the temperature controlled space. The temperature sensor 106 may be disposed in the flow of return air drawn from the temperature controlled space to traverse the heat exchanger coil 52 of the evaporator 50. The pressure sensor 108 may be a conventional pressure sensor, such as for example, pressure transducers, and the temperature sensors 102, 104 and 106 may be conventional temperature sensors, such as for example, digital thermometers, thermocouples or thermistors.

The term "controller" as used herein refers to any method or system for controlling and should be understood to encompass microprocessors, microcontrollers, programmed digital signal processors, integrated circuits, computer hardware, computer software, electrical circuits, application specific integrated circuits, programmable logic devices, programmable gate arrays, programmable array logic, personal computers, chips, and any other combination of discrete analog, digital, or programmable components, or other devices capable of providing processing functions.

When the refrigerant vapor compression system 20 is operating in a temperature maintenance mode to maintain the temperature within the temperature controlled space 12 within a narrow band of a temperature control set point temperature below the freezing point of water, referred to as a frozen control mode, the controller 100 is configured to closely monitor the supply air temperature, the return air temperature and the suction pressure to detect a frozen evaporator coil before the suction pressure is driven below a low suction pressure limit. In refrigerant vapor compression systems charged with carbon dioxide refrigerant or carbon dioxide containing refrigerant mixtures, the low suction pressure limit must be set at a level above the triple point pressure for carbon dioxide of 5.2 bars absolute.

During operation in the frozen control mode, because of the extremely low refrigerant temperature passing through the evaporator heat exchanger coil 52 and the subfreezing (below 32° F.) air temperature with the temperature controlled space, i.e. cargo box 12, ice builds up on the heat transfer surfaces of the evaporator heat exchanger coil 52. As the ice builds-up, the ice blocks more and more of the air flow path through the evaporator 52, thereby causing a reduction in air flow through the evaporator. Additionally, the evaporator cooling capacity is lowered as the ice build-up increases the thermal resistance to heat transfer from the air flow passing through the evaporator to the refrigerant passing through the evaporator heat exchanger coil 52. Although the evaporator cooling capacity deteriorates as the ice builds-up, the reduction in air flow rate through the evaporator caused by the ice build-up is more substantial.

Consequently, if the controller 100 controls operation of the refrigerant vapor compression system through maintaining the return air temperature, $T_{RBAIR}$, to a temperature control set point, the temperature of the air flow leaving the evaporator 50, $T_{SBAIR}$, will decrease. As the supply air temperature, $T_{SBAIR}$, drops, the air flow temperature differential across the evaporator heat exchanger coil, $T_{RBAIR}-T_{SBAIR}$, increases. However, if the controller 100 controls operation of the refrigerant vapor compression system through maintaining the supply air temperature, $T_{SBAIR}$, the temperature of the air flow entering the evaporator 50, $T_{RBAIR}$, will increase. As the return air temperature, $T_{RBAIR}$, rises, the air flow temperature differential across the evaporator heat exchanger coil, $T_{RBAIR}-T_{SBAIR}$, again increases.

To avoid the refrigerant vapor compression system 20 going into on/off cycles of being limited by low suction pressure during operation in a frozen control mode, the controller 100 is configured to continuously monitor the trend of change in suction pressure over time, in addition to also continuously monitoring the trend of change over time in a temperature differential between supply air temperature and return air temperature. The controller 100 is further configured to use the trend over time of change in suction pressure and the trend over time of change over time in a temperature differential between supply air temperature and return air temperature together to detect whether the evaporator heat exchange coil 52 is frozen before a low suction pressure limit is breeched. The controller 100 may be further configured to generate a warning indicating that evaporator heat exchanger coil is becoming frosted whenever both the change in an air flow temperature differential across the evaporator heat exchanger coil over a preselected period of time at least equals a set point threshold change in air flow temperature differential and the change in an evaporator heat exchanger coil refrigerant pressure condition over said preselected period of time at least equals a set point threshold change in refrigerant pressure condition.

In a further aspect of the method disclosed herein, the controller 100 may be configured to initiate a defrost of the evaporator heat exchanger coil if both the current magnitude of the air flow temperature differential across the evaporator heat exchanger coil, $T_{RBAIR}-T_{SBAIR}$, at least equals a set point threshold magnitude for the air flow temperature differential, and the current magnitude of the evaporator heat exchanger coil refrigerant pressure condition, $P_{EVAP}$, at least equals a set point threshold magnitude for the refrigerant pressure condition, the method further includes initiating a defrost of the evaporator heat exchanger coil.

Figure 3:
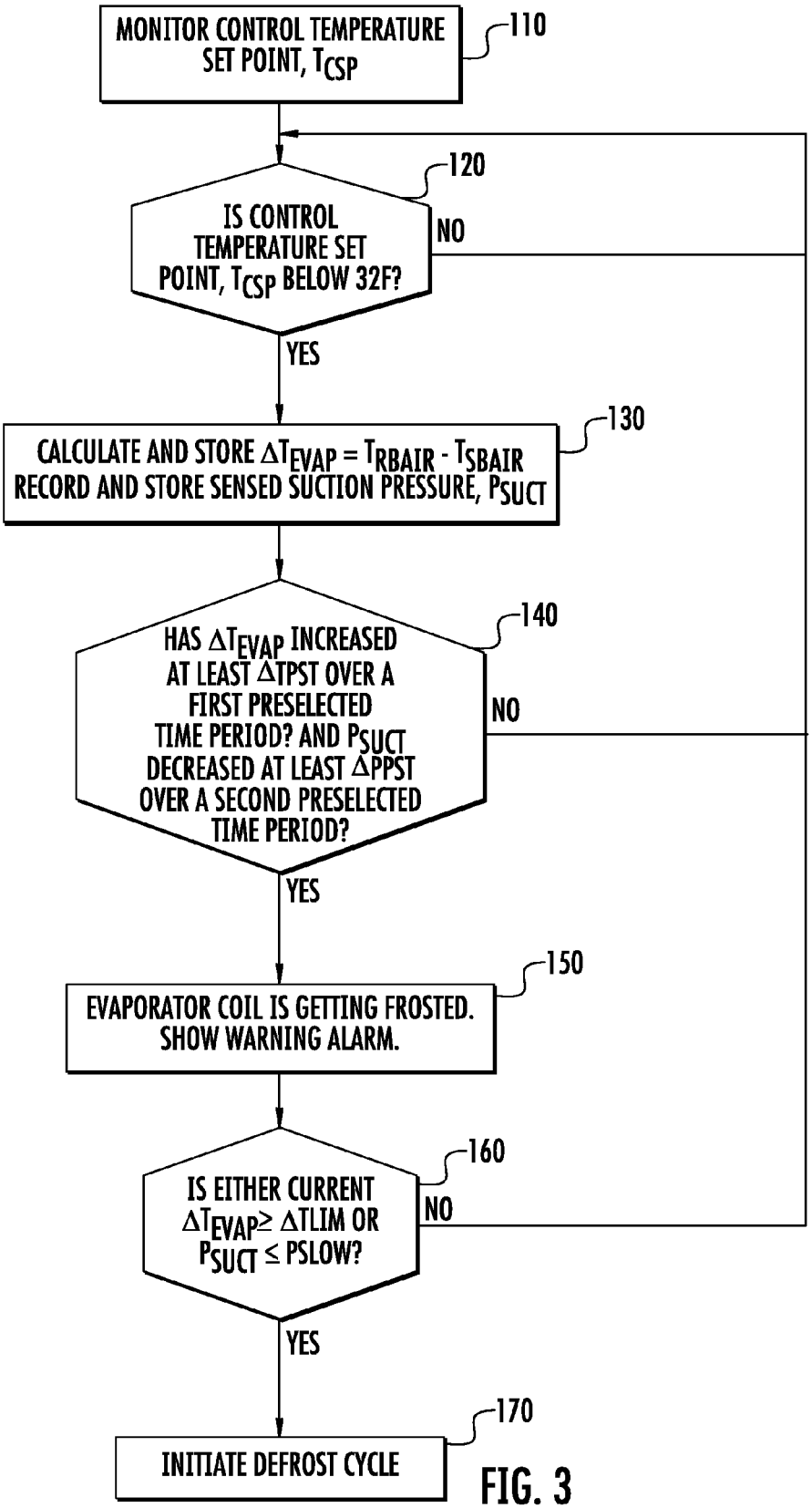
FIG. 3 is a process flow chart illustrating an embodiment of the method disclosed herein for detecting a frozen evaporator coil and initiating a defrost thereof.

Referring now to FIG. 3, a block diagram in the form of a process flow chart illustrates an exemplary embodiment of the method disclosed herein. If the refrigeration vapor compression is operating, at block 110, the controller 100 (e.g., a microprocessor) monitors the control temperature set point, $T_{CSP}$, and at block 120 checks whether the control temperature set point is at or below 32° F. Irrespective of whether the control temperature is the return air temperature or the supply air temperature, if the control temperature set point, $T_{CSP}$, is at or below 32° F., the controller 100, at box 130, calculates the air temperature differential, $T_{EVAP}$, across the evaporator heat exchanger coil 52 by subtracting the sensed supply air temperature, $T_{SBAIR}$, from the sensed return air temperature, $T_{RBAIR}$, and records and stores the calculated air temperature differential, $T_{EVAP}$, with an associated time stamp for future reference. At block 130, the controller 100 also records and stores the sensed suction pressure, $P_{SUCT}$, with an associated time stamp for future reference. Note that the suction pressure represents an evaporator refrigerant pressure condition because in the refrigerant vapor compression system there is no flow restricting valve or other device imparting a pressure drop disposed in the refrigerant line 26 connecting the evaporator heat exchanger coil outlet to the suction inlet of compression device 30*a*.

The controller 100 repeatedly executes block 130 and after a first selected period of time, Δ1*l*, has elapsed, the controller 100 at block 140 determines whether the temperature differential across the evaporator has increased by at least a preset threshold amount, ΔTPST, over the first selected time period. Also at block 140, after a second selected period of time, Δt2, has elapsed, the controller 100 determines whether the suction pressure has decreased by at least a preset threshold amount, ΔPPST, over the second selected period of time. If both the temperature differential across the evaporator has increased over the first selected period of time by at least the preset threshold amount of degrees and the suction pressure has decreased by at least the preset threshold amount of pressure units, the controller 100, at block 150, will generate a warning that the evaporator coil is getting frosted.

For example, in the exemplary embodiment of the method depicted in FIG. 3, if both TEVAP(t+Δt1)−TEVAP(t) is > or =ΔTPST, for example by at least 0.5° F. (0.28° C.) and PSUCT(t)−PSUCT(t+Δt2) is > or =ΔPPST, for example by at least 10 psia (0.69 bars), the controller will generate a warning that the evaporator coil 52 is getting frosted. The warning may be in the form of a text message, a visual indicator, an audible indicator, or other alarm. The first and second selected periods of time may be different, but it is currently contemplated that the first and second periods of time will generally be the same and run coincidently. For example, in an embodiment, the first and second periods of time of time may both be on the order of ten minutes, although other periods of time, greater or lesser than ten minutes may be selected. Additionally, the temperature differential preset threshold of 0.5° F. (0.28° C.) and the suction pressure differential preset threshold of 10 psia (0.69 bars) are exemplary and greater or lesser magnitude differential limits may be used.

Referring again to the process flow chart of FIG. 3, after determining that the evaporator coil is getting frosted, the controller 100 will continue to monitor the air temperature differential across the evaporator and the suction pressure and at block 160 compares the current air temperature across the evaporator to a preset air temperature differential limit and will compare the current suction pressure to a preset lower limit for suction pressure. If the controller 100 determines at block 160 that either the current air temperature across the evaporator equals or exceeds the preset air temperature differential limit, ΔTLIM, or the current suction pressure equals or is less than the preset lower limit for suction pressure, ΔPSLOW, the controller 100 will, at block 170, initiate a defrost cycle to melt the ice build-up from the evaporator heat exchanger coil 52. For example, for a refrigerant vapor compression system charged with carbon dioxide, the preset lower limit for suction pressure may be a pressure greater than the triple point pressure for carbon dioxide, that is 5.2 bars absolute. In an embodiment, for example, the preset air temperature differential limit may be 20° F. (11° C.). It is to be understood that the particular values selected for the preset lower limit for suction pressure and the preset air temperature differential limit are application specific preferences. The particular form of defrost used is not germane and any suitable form of defrost, for example electric defrost or hot gas defrost, may be used.

The terminology used herein is for the purpose of description, not limitation. Specific structural and functional details disclosed herein are not to be interpreted as limiting, but merely as basis for teaching one skilled in the art to employ the present invention. Those skilled in the art will also recognize the equivalents that may be substituted for elements described with reference to the exemplary embodiments disclosed herein without departing from the scope of the present invention.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present disclosure not be limited to the particular embodiment(s) disclosed as, but that the disclosure will include all embodiments falling within the scope of the appended claims.

I claim:

1. A method for preventing a frosted evaporator heat exchanger coil of a refrigerant vapor compression system for supplying conditioned air to a temperature controlled space, the method comprising:

determining whether a change in an air flow temperature differential across the evaporator heat exchanger coil over a preselected period of time at least equals a set point threshold change in air flow temperature differential;

determining whether a change in a refrigerant pressure condition on a low pressure side of the refrigerant vapor compression system over said preselected period of time at least equals a set point threshold change in refrigerant pressure condition;

if both the change in an air flow temperature differential across the evaporator heat exchanger coil over a preselected period of time at least equals a set point threshold change in air flow temperature differential and the change in a refrigerant pressure condition on a low pressure side of the refrigerant vapor compression system over said preselected period of time at least equals a set point threshold change in refrigerant pressure condition, determining whether a current magnitude of the air flow temperature differential across the evaporator heat exchanger coil at least equals a set point threshold magnitude for the air flow temperature differential, and determining whether a current magnitude of the evaporator heat exchanger coil refrigerant pressure condition at least equals a set point threshold magnitude for the refrigerant pressure condition; and initiating a defrost of the evaporator heat exchanger coil if both the current magnitude of the air flow temperature differential across the evaporator heat exchanger coil at least equals a set point threshold magnitude for the air flow temperature differential, and the current magnitude of the evaporator heat exchanger coil refrigerant pressure condition at least equals a set point threshold magnitude for the refrigerant pressure condition.

2. The method as set forth in claim 1 further comprising generating a warning indicating that the evaporator heat exchanger coil is becoming frosted whenever both the change in an air flow temperature differential across the evaporator heat exchanger coil over a preselected period of time at least equals a set point threshold change in air flow temperature differential and the change in an evaporator heat exchanger coil refrigerant pressure condition over said preselected period of time at least equals a set point threshold change in refrigerant pressure condition.

3. The method as set forth in claim 1 wherein determining whether a change in an air flow temperature differential across the evaporator heat exchanger coil over a preselected period of time at least equals a set point threshold change in air flow temperature differential comprises:

at a first time sensing the return air temperature of the air flow returning from the temperature controlled space to pass over the evaporator heat exchanger coil, sensing the supply air temperature of the air flow having passed over the evaporator heat exchanger coil to be supplied to the temperature controlled space, and calculating the air flow temperature differential at the first time by subtracting the sensed supply air temperature from the return air temperature;

at a second time the preselected period of time after the first time sensing the return air temperature of the air flow returning from the temperature controlled space to pass over the evaporator heat exchanger coil, sensing the supply air temperature of the air flow having passed over the evaporator heat exchanger coil to be supplied to the temperature controlled space, and calculating the air flow temperature differential at the second time by subtracting the sensed supply air temperature from the return air temperature;

calculating a differential between the air flow temperature differential at the second time and the air flow temperature differential at the first time; and comparing the differential between the air flow temperature differential at the second time and the air flow temperature differential at the first time to the set point threshold change in air flow temperature differential.

4. The method as set forth in claim 1 wherein determining whether a change an evaporator heat exchanger coil refrigerant pressure condition over said preselected period of time at least equals a set point threshold change in refrigerant pressure condition comprises:

sensing the evaporator heat exchanger coil refrigerant pressure condition at a first time and a second time the preselected period of time after the first time;

calculating a change in the evaporator heat exchanger coil refrigerant pressure condition over the selected period of time by subtracting the magnitude of the sensed evaporator heat exchanger coil refrigerant pressure condition at the first time from the magnitude of the sensed evaporator heat exchanger coil refrigerant pressure condition at the second time; and comparing the calculated change in the evaporator heat exchange coil refrigerant pressure condition to the set point threshold change in refrigerant pressure condition.

5. The method as set forth in claim 4 wherein the refrigerant pressure condition on a low pressure of the refrigerant vapor compression system is selected from the group consisting of a compressor suction pressure, an evaporator outlet refrigerant pressure, and an evaporator inlet refrigerant pressure.

6. The method as set forth in claim 1 wherein the refrigerant vapor compression system comprises a transcritical refrigerant vapor compression system charged with carbon dioxide refrigerant.

7. The method as set forth in claim 6 wherein the set point threshold magnitude of the sensed evaporator heat exchanger coil refrigerant pressure condition is greater than 5.2 bars absolute.

8. The method as set forth in claim 6 wherein the set point threshold magnitude of the air flow temperature differential is greater than 20° F. (11° C.).

9. The method as set forth in claim 1 wherein the temperature controlled space comprises a refrigerated cargo box of an intermodal container, a trailer or a truck.

* * * * *